US007328872B2

(12) United States Patent
Zahornacky

(10) Patent No.: US 7,328,872 B2
(45) Date of Patent: Feb. 12, 2008

(54) REMOTELY PROGRAMMABLE INTERGRATED CONTROLLER FOR MODEL TRAIN ACCESSORIES

(76) Inventor: Jon F. Zahornacky, 939 Wood Duck Ave., Santa Clara, CA (US) 95051

( * ) Notice: Subject to any disclaimer, the term of this patent is extended or adjusted under 35 U.S.C. 154(b) by 562 days.

(21) Appl. No.: 10/819,578

(22) Filed: Apr. 6, 2004

(65) Prior Publication Data

US 2005/0225425 A1 Oct. 13, 2005

(51) Int. Cl.
*B61L 7/00* (2006.01)

(52) U.S. Cl. ..... 246/219; 246/3; 246/5; 246/187 A

(58) Field of Classification Search ..... 246/187 R, 246/219, 187 A, 182 R, 167 R, 3, 4, 5; 381/86; 105/26.05; 104/295, 296, 301; 318/280, 318/282, 286; 340/825.21, 693.3, 693.4, 340/825.69, 825.52; 701/19, 20; 446/409, 446/410

See application file for complete search history.

(56) References Cited

U.S. PATENT DOCUMENTS 6,320,346 B1 * 11/2001 Graf ..... 318/580

OTHER PUBLICATIONS

The Digitrax Big Book of DCC, Digitrax Inc., Ch-7, pp. 83-102, 1999.*

* cited by examiner

*Primary Examiner*—Mark Tuan Le
(74) *Attorney, Agent, or Firm*—Donald W. Meeker

(57) ABSTRACT

An integrated controller system for use with existing railroad model accessories and operating cars comprises a miniaturized receiving device having a pulse recovery circuit, a micro-controller decoder circuit, an output driver circuit, and a specialized power distribution circuit. The integrated controller system is adapted for remote programming and control by an existing remote control. Features include remote assignment of programmable voltage and pulse duration, specialized power distribution to sustain brief power interruptions, an integrated antenna for ease of installation, remote programmability for ID and class assignment, Soft Set Technology™, field upgradeable firmware, and very small size.

9 Claims, 5 Drawing Sheets

PULSE RECOVERY CIRCUIT

MICRO-CONTROLLER DECODER CIRCUIT

SPECIALIZED POWER DISTRIBUTION CIRCUIT

PULSE RECOVERY CIRCUIT

MICRO-CONTROLLER DECODER CIRCUIT

OUTPUT DRIVER CIRCUIT

SPECIALIZED POWER DISTRIBUTION CIRCUIT

INTEGRATED RECEIVER

REMOTELY PROGRAMMABLE INTERGRATED CONTROLLER FOR MODEL TRAIN ACCESSORIES

BACKGROUND OF THE INVENTION

1. Field of the Invention

The present invention relates to model railroad accessories and particularly to an integrated controller for a model train that may be remotely programmed and operated, which comprises a microprocessor decoder with specialized power distribution, output drivers and pulse receiver with built in antenna circuits that attach to the accessories and operating cars.

2. Description of the Prior Art

Model railroad systems are typically controlled by power supplied through the tracks. A transformer electrically connected to a conventional home wall outlet converts household alternating current into power suitable for operating the train. The HO standard model railway system uses power characterized as direct current, while S and O/27 three-rail model railway systems such as American Flyer and Lionel typically use alternating current. The transformer is connected to the railway track to provide a potential difference, or voltage, between the rails. Typically, the voltage is supplied to the wheels on the locomotive or other rail car of the model railway system via the rails to an electric motors and lighting on the locomotive and on operating cars. Alternatively, a third rail can be used to supply voltage via a pickup roller to the electric motor or lights.

The amplitude of the voltage applied to the rails generally controls the speed of travel of the model train on the track. However, when a remote-control system is used, such as the Lionel TMCC (Trainmaster Command Control) for three-rail O-gauge or the DCC (Digital Command Control) for HO, the voltage remains constant on the track, while an internal circuit in the engine receives digital commands through the track or by radio and controls the amount of track voltage reaching the motors and lighting. The method of reversing the direction of travel of the train varies from control system to control system.

Currently, other products focus on engines or provide large under track layout boxes that control multiple accessories and these products are fairly large. The other products have multiple circuit boards and could never fit into much beyond engines or specialized cars with plenty of room that can contain large electronics. They have more features to be so universal, but at a cost of limited applicability.

All accessories operate at different voltages, and operating cars especially work only in a limited range of voltages. The introduction of remote cab control is recent, and many pre remote cab control operating cars do not work at all in this environment. This is due to the fact that remote cab control systems set the track voltage to a constant maximum voltage. Thus all items riding on the tracks can utilize full voltage, but unfortunately this causes problems. For example, one variety of operating cars was designed when the variable track voltage was used to control engine speed, and typically the track voltage was typically applied at about 50% of maximum for normal operation. Now that remote systems require track voltage to be set at maximum, these operating cars will malfunction, as they are not designed to operate at the maximum voltage.

While wireless solutions do exist, none are capable of supporting certain types of operating cars that operate over specific track sections, ostensibly known as "operating tracks". These operating tracks apply voltage to special power collectors to initiate operation. The current products available simply do not fit into these types of cars, which is why they must be positioned over the operating tracks. (Voltage and pulse duration also plays a factor here as well)

U.S. Pat. No. 5,394,068, issued Feb. 28, 1995 to Severson, discloses automatic initialization in a model railroad motor control system. Electronic control circuits are provided for model railroading including a reversing motor control circuit. An on-board electronic state machine indicates one at a time of a predetermined series of states including forward, neutral and reverse, and is clocked to the next state responsive to an interrupt in the track power signal. The circuit further includes reset means for resetting the state machine directly to a neutral state responsive to an interruption of the track power signal of extended duration. The state machine can be remotely programmed to reset to any desired one of the series of states in response to a track power signal interrupt. The unique reset state is useful for receiving various remote control signals without driving the motor.

U.S. Patent Application No. 20030148698, published Aug. 7, 2003 by Koenig, describes a method and an arrangement for the accurate, realistic automatic or semi-automatic control of track-guided toys, such as electrically operated model railways and trains. In accordance with the invention type- and/or geometry-specifying memory components, readable by non-contact means, are disposed at or in each track, track piece, buffer, signal and/or switch that is to be included in the structure, such that each memory component and hence each track in addition exhibits an identification code that is not repeated within the series of such codes. Furthermore the rolling stock, preferably the locomotives, are equipped with a memory-reading device as well as a data-transmission means for revertive communication. After a first trip around the route, an electronic representation of the route configuration is available and can be preserved in a central memory. During subsequent trips around the route, the momentary position on the roadway or of the train is determined by reading memory components and revertive signaling to the central memory or a central control system, such that on the basis of pre-specifiable tasks associated with operation of the railway, taking into account the route and velocity information as well as special functions, one or more machines are independently monitored and controlled.

U.S. Patent Application No. 20010015578, published Aug. 23, 2001 by Westlake, discloses a plural output control station for operating electrical apparatus, such as model electric train engines and accessories. The control station employs a data processor for monitoring and controlling the signals generated at a plurality of transformer-driven power output terminals. An exemplary station includes two variable-voltage alternating current (AC) output channels (TRACK 1 and TRACK 2) and two fixed-voltage AC output channels (AUX 1 & AUX 2). The variable-voltage outputs are controlled by a data processor responsive to respective operator-controlled throttles for varying the AC output voltage and therefore the rate of movement and direction of electric train engines, typically three-rail O-gauge model trains. The variable-voltage outputs can also be offset by the data processor with positive and negative DC voltages for enabling engine functions such as horns, whistles and bells. The variable-voltage outputs are controlled by the data processor to also communicate control parameters to electric train engines for the operation and programming of various electric train engine features and accessories. The plurality of outputs are monitored by the data processor to ensure that predetermined voltage and/or current limits are not exceeded by any individual output and that a predetermined power limit is not exceeded by any individual output or by any combination of outputs.

U.S. Pat. No. 6,457,681, issued Oct. 1, 2002 to Wolf, shows a control, sound, and operating system for model trains, which provides a user with increased operating realism. A novel remote control communication capability between the user and the model trains includes a handheld remote control on which various commands may be entered, and a Track Interface Unit that retrieves and processes the commands. The Track Interface Unit converts the commands to modulated signals (preferably spread spectrum signals), which are sent down the track rails. The model train picks up the modulated signals, retrieves the entered command, and executes it through use of a processor and associated control and driver circuitry. A speed control circuit located inside the model train is capable of continuously monitoring the operating speed of the train and making adjustments to a motor drive circuit. Circuitry is connected to the Track Interface Unit to an external source, such as a computer, CD player, or other sound source, so that real-time sounds stream down the model train tracks for playing through the speakers located in the model train. Coupler designs and circuits, as well as a smoke unit, can also be used with the model train system.

U.S. Pat. No. 6,619,594, issued Sep. 16, 2003 to Wolf, is for a control, sound, and operating system for model trains, which provides a user with increased operating realism. A novel remote control communication capability between the user and the model trains. This feature is accomplished by using a handheld remote control on which various commands may be entered, and a Track Interface Unit that retrieves and processes the commands. The Track-Interface Unit converts the commands to modulated signals in the form of data bit sequences (preferably spread spectrum signals), which are sent down the track rails. The model train picks up the modulated signals, retrieves the entered command, and executes it through use of a processor and associated control and driver circuitry. A speed control circuit located inside the model train that is capable of continuously monitoring the operating speed of the train and making adjustments to a motor drive circuit, as well as a novel smoke unit. Circuitry for connecting the Track Interface Unit to an external source, such as a computer, CD player, or other sound source, and have real-time sounds stream down the model train tracks for playing through the speakers located in the model train.

U.S. Patent Application No. 20030019979, published Jan. 30, 2003 by Wolf, puts forth a control, sound, and operating system for model trains, which provides a user with increased operating realism. Disclosed is a novel remote control communication capability between the user and the model trains. This feature is accomplished by using a handheld remote control on which various commands may be entered, and a Track Interface Unit that retrieves and processes the commands. The Track Interface Unit converts the commands to modulated signals (preferably spread spectrum signals), which are sent down the track rails. The model train picks up the modulated signals, retrieves the entered command, and executes it through use of a processor and associated control and driver circuitry. Another novel feature disclosed is a speed control circuit located inside the model train that is capable of continuously monitoring the operating speed of the train and making adjustments to a motor drive circuit. The present invention also discloses circuitry for connecting the Track Interface Unit to an external source, such as a computer, CD player, or other sound source, and have real-time sounds stream down the model train tracks for playing through the speakers located in the model train. Novel coupler designs and circuits, as well as a novel smoke unit, are also disclosed.

U.S. Patent Application No. 20030015626, published Jan. 23, 2003 by Wolf, concerns a control, sound, and operating system for model trains, which provides a user with increased operating realism. Disclosed is a novel remote control communication capability between the user and the model trains. This feature is accomplished by using a handheld remote control on which various commands may be entered, and a Track Interface Unit that retrieves and processes the commands. The Track Interface Unit converts the commands to modulated signals (preferably spread spectrum signals), which are sent down the track rails. The model train picks up the modulated signals, retrieves the entered command, and executes it through use of a processor and associated control and driver circuitry. Another novel feature disclosed is a speed control circuit located inside the model train that is capable of continuously monitoring the operating speed of the train and making adjustments to a motor drive circuit. The present invention also discloses circuitry for connecting the Track Interface Unit to an external source, such as a computer, CD player, or other sound source, and have real-time sounds stream down the model train tracks for playing through the speakers located in the model train. Novel coupler designs and circuits, as well as a novel smoke unit, are also disclosed.

U.S. Patent Application No. 20030006346, published Jan. 9, 2003 by Wolf, illustrates a control, sound, and operating system for model trains, which provides a user with increased operating realism. Disclosed is a novel remote control communication capability between the user and the model trains. This feature is accomplished by using a handheld remote control on which various commands may be entered, and a Track Interface Unit that retrieves and processes the commands. The Track Interface Unit converts the commands to modulated signals (preferably spread spectrum signals), which are sent down the track rails. The model train picks up the modulated signals, retrieves the entered command, and executes it through use of a processor and associated control and driver circuitry. Another novel feature disclosed is a speed control circuit located inside the model train that is capable of continuously monitoring the operating speed of the train and making adjustments to a motor drive circuit. The present invention also discloses circuitry for connecting the Track Interface Unit to an external source, such as a computer, CD player, or other sound source, and have real-time sounds stream down the model train tracks for playing through the speakers located in the model train. Novel coupler designs and circuits, as well as a novel smoke unit, are also disclosed.

U.S. Patent Application No. 20030001051, published Jan. 2, 2003 by Wolf, puts forth a control, sound, and operating system for model trains, which provides a user with increased operating realism. Disclosed is a novel remote control communication capability between the user and the model trains. This feature is accomplished by using a handheld remote control on which various commands may be entered, and a Track Interface Unit that retrieves and processes the commands. The Track Interface Unit converts the commands to modulated signals (preferably spread spectrum signals), which are sent down the track rails. The model train picks up the modulated signals, retrieves the entered command, and executes it through use of a processor and associated control and driver circuitry. Another novel feature disclosed is a speed control circuit located inside the model train that is capable of continuously monitoring the operating speed of the train and making adjustments to a motor drive circuit. The present invention also discloses circuitry for connecting the Track Interface Unit to an external source, such as a computer, CD player, or other sound source, and have real-time sounds stream down the model train tracks for playing through the speakers located in the model train. Novel coupler designs and circuits, as well as a novel smoke unit, are also disclosed.

U.S. Patent Application No. 20030167106, published Sep. 4, 2003 by Rau, shows a model railroad control and display system, comprising a software tool and an electronic interface facilitate model railroaders in initiating, monitoring and directing the path trains (i.e. engine and rail cars) will traverse on the model layout. The software tool and an electronic interface are connected to one of the I/O ports of a computer. The display presented on the computer monitor will mimic the model railroad layout depicting each track turnout with a red or green path. The green path depicts the selected path through the turnout while the red path is the deselected path. With all turnouts displayed simultaneously the condition of the layout relative to train movement can be seen at once by following the green paths. To change the path through a turnout, the user places the cursor on the representation of the turnout on the computer display and performs a left mouse button click. The software will recognize the particular turnout selected and cause a momentary actuating signal to be sent to the track's turnout motor through the electronic interface. The software will rewrite the red/green legs of the display to maintain the agreement of the display with the physical layout turnout.

U.S. Pat. No. 6,445,150, issued Sep. 3, 2002 to Tanner, shows a software-driven motor and solenoid controller. An apparatus and method are provided for controlling electrical devices such as electric trains using a computer. The invention utilizes standard ports that appear on most computers, and works with standard well-known widely commercially available train sets. The invention has customized software and circuitry for managing the speed and direction of one or more motors, and also for controlling the configuration of track turnouts. The invention can also be configured and updated by the user to fit the characteristics of a user's specific layout.

U.S. Pat. No. 5,251,856, issued Oct. 12, 1993 to Young, claims a model train controller for reversing unit, in which a control circuit which will momentarily apply a pulse of power to the E-Unit solenoid in response to the momentary interruption of power by the transformer or another control signal. The E-Unit rest state is thus with no power applied, eliminating noise and saving power. A seek-to-forward cycling capability is also provided. The overall system has a remote transmitter and a base unit coupled to the train tracks with a receiver. The base unit controls track switching and individual trains through FSK signals transmitted over the track. The base unit also controls a triac switch between the transformer and the track to allow remote control of track power and impose DC offsets on the track power signal.

U.S. Pat. No. 5,749,547, issued May 12, 1998 to Young, indicates a controller for model trains on a train track. The controller causes direct current control signals to be superimposed on alternating current power signals to control effects and features on model vehicles. The model vehicle includes a receiver unit responsive to the direct current control signals.

U.S. Pat. No. 5,638,522, issued Jun. 10, 1997 to Dunsmuir, puts forth a graphically constructed control and scheduling system. A system and method are provided for controlling a model train system and for defining a finite state machine for implementing control of the system. A computer that is running a graphic user operating system is coupled through its serial port to a master control unit (MCU). The MCU is coupled to slave control units (SCUs) and to a hand control unit (HCU) through a token ring network over which the computer transmits commands to energize selected track sections and to control the speed of locomotives running thereon. The MCU and SCUs are coupled to the sections of tracks and to electromagnetic switches that determine the route of the trains over the sections of track. Furthermore, detector circuits monitor a detector pulse to sense the presence of a locomotive or train on a particular section of track, producing an indicative output signal that is provided to the computer. The user graphically defines events, conditions, and control actions that are to be carried out on a visually displayed schedule manager grid. In addition, the user can graphically define a control panel that includes graphic controls, which can be manipulated by the user to establish the speed of a locomotive and to control the status of the electromagnetic switches. The control system can also be applied to control other systems that include electrically energized components.

U.S. Pat. No. 5,493,642, issued Feb. 20, 1996 to Dunsmuir, describes a graphically constructed control and scheduling system, which comprises a system and method for controlling a model train system and for defining a finite state machine for implementing control of the system. A computer that is running a graphic user operating system is coupled through its serial port to a master control unit (MCU). The MCU is coupled to slave control units (SCUs) and to a hand control unit (HCU) through a token ring network over which the computer transmits commands to energize selected track sections and to control the speed of locomotives running thereon. The MCU and SCUs are coupled to the sections of tracks and to electromagnetic switches that determine the route of the trains over the sections of track. Furthermore, detector circuits monitor a detector pulse to sense the presence of a locomotive or train on a particular section of track, producing an indicative output signal that is provided to the computer. The user graphically defines events, conditions, and control actions that are to be carried out on a visually displayed schedule manager grid. In addition, the user can graphically define a control panel that includes graphic controls, which can be manipulated by the user to establish the speed of a locomotive and to control the status of the electromagnetic switches. The control system can also be applied to control other systems that include electrically energized components.

U.S. Pat. No. 5,441,223, issued Aug. 15, 1995 to Young, concerns a model train controller using electromagnetic field between track and ground. The controller transmits control signals between a rail of the track and earth ground, generating an electromagnetic field, which extends for several inches around the track. A receiver in the locomotive can then pick up signals from this electromagnetic field.

U.S. Pat. No. 6,014,934, issued Jan. 18, 2000 to Pierson, claims a modular circuit board arrangement for use in a model train, which includes a motherboard mounted on the model train platform. The motherboard has receptacles that accept and communicate signals with a plurality of removable circuit modules for controlling model train operations. These circuit modules may include, for example, a light control circuit module and a sound control circuit module.

U.S. Pat. No. 6,441,570, issued Aug. 27, 2002 to Grubba, shows a controller for a model toy train set. In a first aspect of the invention, the controller includes a plurality of input connectors for receiving supply power from one or more remote power supplies and providing such power to a plurality of output connectors. In a second aspect of the invention, the controller includes an input device for producing an input signal to limit the amount of output power supplied from the controller to a toy train set when the controller is remotely operated from a remote transmitter. In a third aspect of the invention, the controller includes a programming circuit having a first mode for controlling a plurality of output channels from separate sets of inputs and a second mode for controlling the plurality of output channels from a single set of inputs.

The prior art above does not adequately address the need for a way to remotely program and control model railroad trackside accessories and operating cars. What is needed is a very small receiver that is compatible with the current transmissions systems to extend the usefulness of remote operation to legacy operating cars and trackside accessories. This receiver needs to be able to supply varying voltages and pulse durations to support the variety of products being retro-fitted for remote operation. Ease of installation and ease of use, particularly in being able to program the receiver remotely using existing computers and handheld transmitters, are features required to extend the usefulness of the invention. The small size is paramount to the invention's success, as many operating cars have limited space for inclusion of electronics.

SUMMARY OF THE INVENTION

An object of the present invention is to provide a wireless integrated controller which features remote operating class and ID assignment, outputs with selectable voltages and pulse durations, specialized power distribution to sustain brief power interruptions, an integrated antenna for ease of installation, field upgradeable firmware, Soft Set Technology™ for simplicity of setup, and very small size for installation in the limited space available on model railroad rolling stock and accessories, which can be applied to any operating car, trackside accessory, turnout switch, or any device that needs remotely controllable power.

Another object of the present invention is to provide an integrated controller which also applies to all model railroad trackside accessories by simply connecting the present invention to the terminals under the accessory, and then attaching the present invention under the accessory and simply connecting the two wires to the track for power (as constant voltage is available there) and operates by simply selecting the accessory class and unit ID number assigned on the remote cab while also making the accessory easy to relocate and configure.

In brief, an integrated controller is applicable to model railroad accessories. These accessories are applicable to multiple train scales represented by "HO", "S" and "O27/O" gauge. Accessories consist of turnout switches, lighting, trackside units, and operating cars.

The integrated controller of the present invention uses a remote receiver which comprises a pulse receiver, a micro-controller decoder with specialized power distribution, and output drivers and an integrated antenna, all in a very small package. The integrated controller system provides remote assignment of programmable voltage and pulse duration, specialized power distribution to sustain brief power interruptions, an integrated antenna for ease of installation, remote programmability for unit ID assignment, field upgradeable firmware, Soft Set Technology™, and very small size. The size is paramount to the installation of rolling stock accessories. The actual receiving device with the integrated antenna of the present invention is: 0.95"W×2"L×0.5"H.

Any operating car, trackside accessory, turnout switch, or any device that needs controllable power can be operated with the present invention. The present invention targets mobile, small size, programmable voltage/pulse environments.

Remote assignment of voltage and pulse duration is paramount to the success of this product, and is unique and key to the present invention. To avoid prior art problems with maximum voltage exceeding the capacity of the operating cars, with the introduction of the present invention; the operating cars can be retrofitted to run again. The present invention can remotely set the voltage and pulse duration for operation of the cars and accessories and can actually turn it on and off remotely.

Small size coupled with an integrated antenna make the receiving device of the present invention attractive and unique for use in environments never before possible. The present invention controls the car anywhere on the layout, and thereby eliminates the cost and relocation of operating tracks, wiring and switches to trigger them.

Power noise immunity is a key attribute of the present invention and is accomplished with specialized power distribution that keeps the micro-controller supplied with voltage and running normally under brief interruptions of power. The key to operating cars control stability is managed by isolating the micro-controller power. This isolation allows the micro-controller to stay active when the power is briefly interrupted. While this may not keep the accessory running, the micro-controller will deliver the command signals reliably to the operating car so when full power is restored the car will operate correctly. If the power interruption is brief enough (less than a few seconds); the operating car will show no behavioral difference. If the power is interrupted long enough, the micro-controller will reset and stop the operating car functions. While this is desirable under long interruptions of power, many brief interruptions occur normally while an operating car moves along the track. The power circuitry keeps the operating car "alive" through these brief interruptions and provides continuous operation; which is the expected and desired behavior.

Remote programmability for unit class assignment is a unique feature in the present invention. The present invention allows multi purpose assignment to the engine, accessory, or turnout switch class. The invention memorizes the sequence applied at configure time and will respond to the class (i.e.: switch, accessory) of command issued when in normal operation.

A field upgradeable micro-controller firmware in the present invention allows for remote and electronic bug fixes and allows hobbyists to enhance the present invention operation. The field programmable micro-controller firmware allows for code updates to be made available to the user to correct and or enhance features in the field.

It is possible to make the basic firmware source available to limited OEM's to adapt the invention to a new series of products at their leisure. Thus the invention becomes a part of the development cycle for the OEM, insuring the continued use of the invention.

An advantage of the present invention is that it targets mobile, small size, programmable voltage environments and can be applied to any operating car, trackside accessory, turnout switch, or any device that needs controllable power.

Another advantage of the present invention is that it also works for larger trackside accessory operation and makes them easy to relocate and configure.

An additional advantage of the present invention is that it provides remote assignment of programmable voltage and pulse duration.

One more advantage of the present invention is that it provides specialized power distribution to sustain brief power interruptions.

Yet another advantage of the present invention is that it provides an integrated antenna for ease of installation and to maintain a miniature size.

Still another advantage of the present invention is that it provides remote programmability for unit class assignment.

One further advantage of the present invention is that it provides field upgradeable firmware.

An additional advantage of the present invention as that it provides a system which is easily upgradeable to satisfy future needs.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 4:
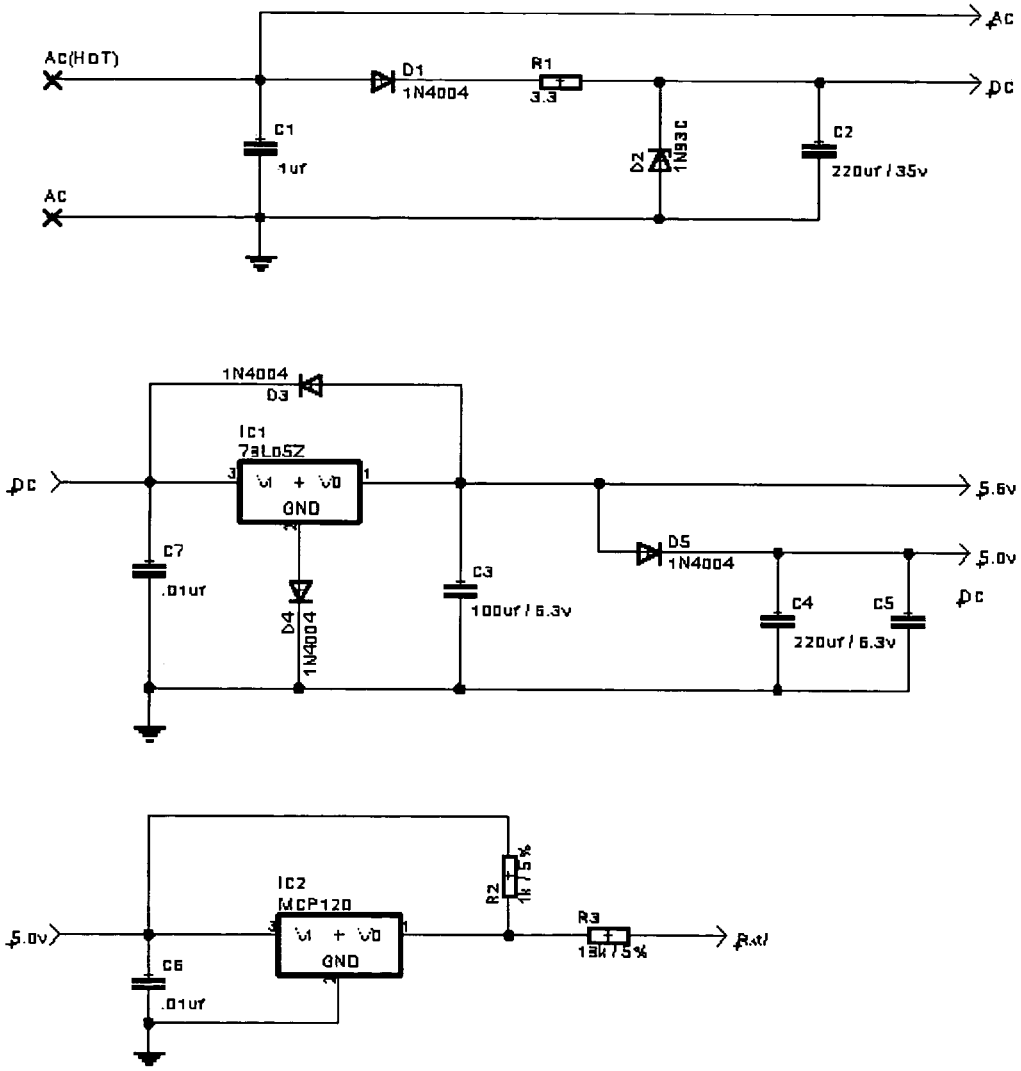
FIG. 4 is a diagrammatic view of the specialized power distribution circuit of the present invention.
Figure 5:
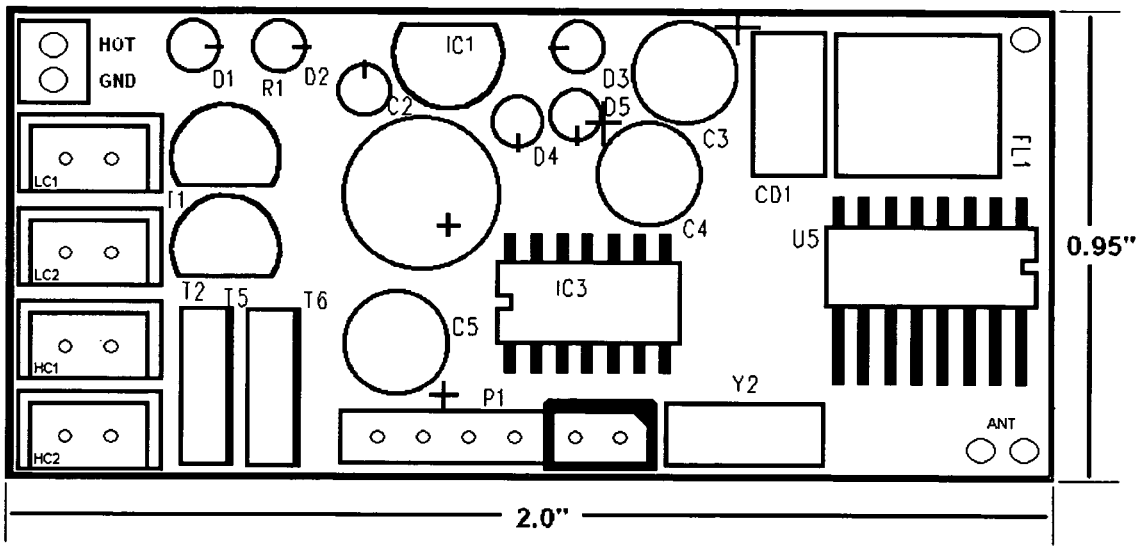
FIG. 5 is a plan view of the receiving device of the present invention, which mounts on a model railroad operating car or accessory.

Referring to the drawings, the integrated controller system for railroad model accessories and operating cars of the present invention comprises a pulse recovery circuit (FIG. 1), a micro-controller decoder circuit (FIG. 2) to decode the recovered pulses, an output driver circuit (FIG. 3), and a specialized power distribution circuit (FIG. 4), all four circuits and a built-in antenna being housed in a miniaturized receiving device (FIG. 5).

Figure 1:
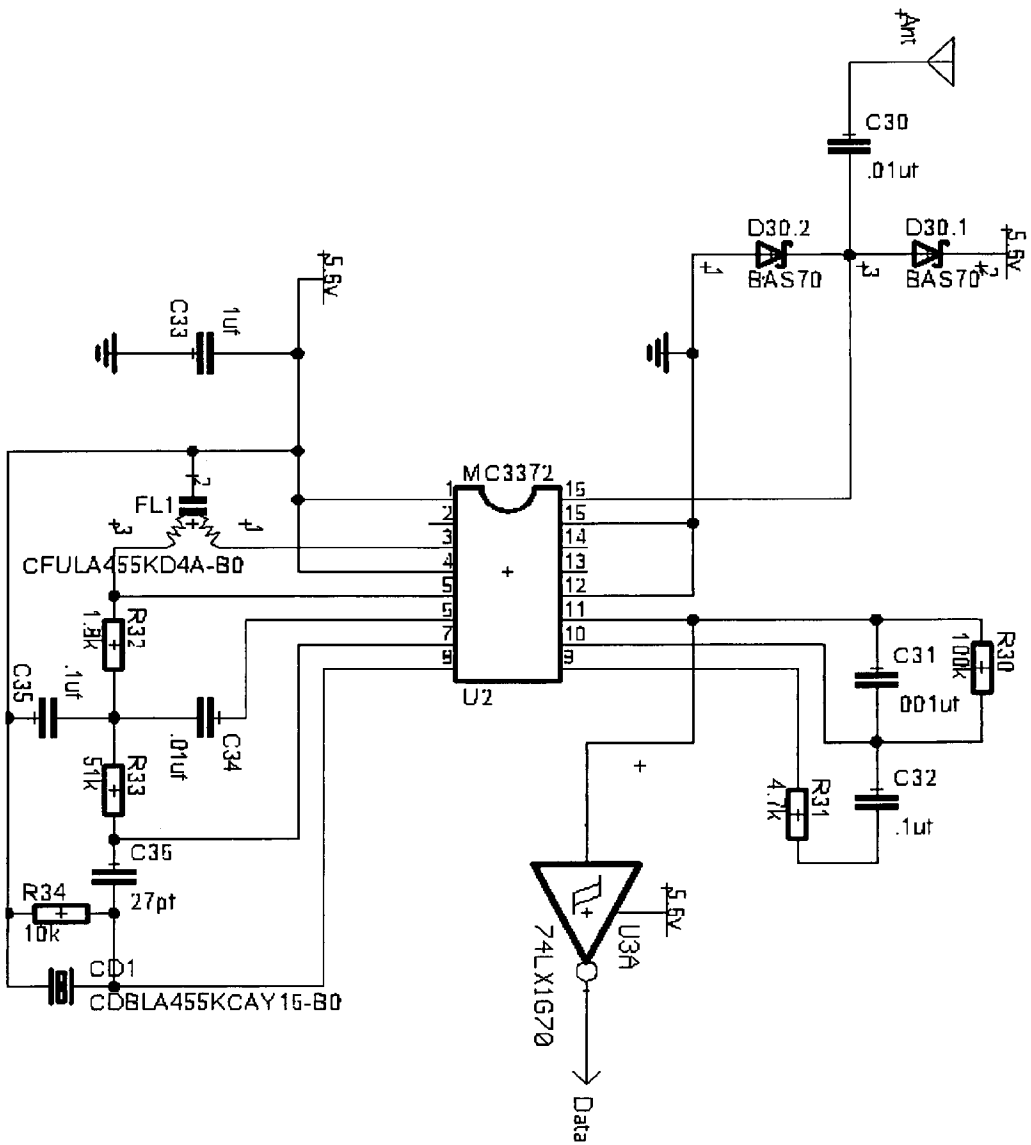
FIG. 1 is a diagrammatic view of the pulse recovery circuit of the present invention.
Figure 2:
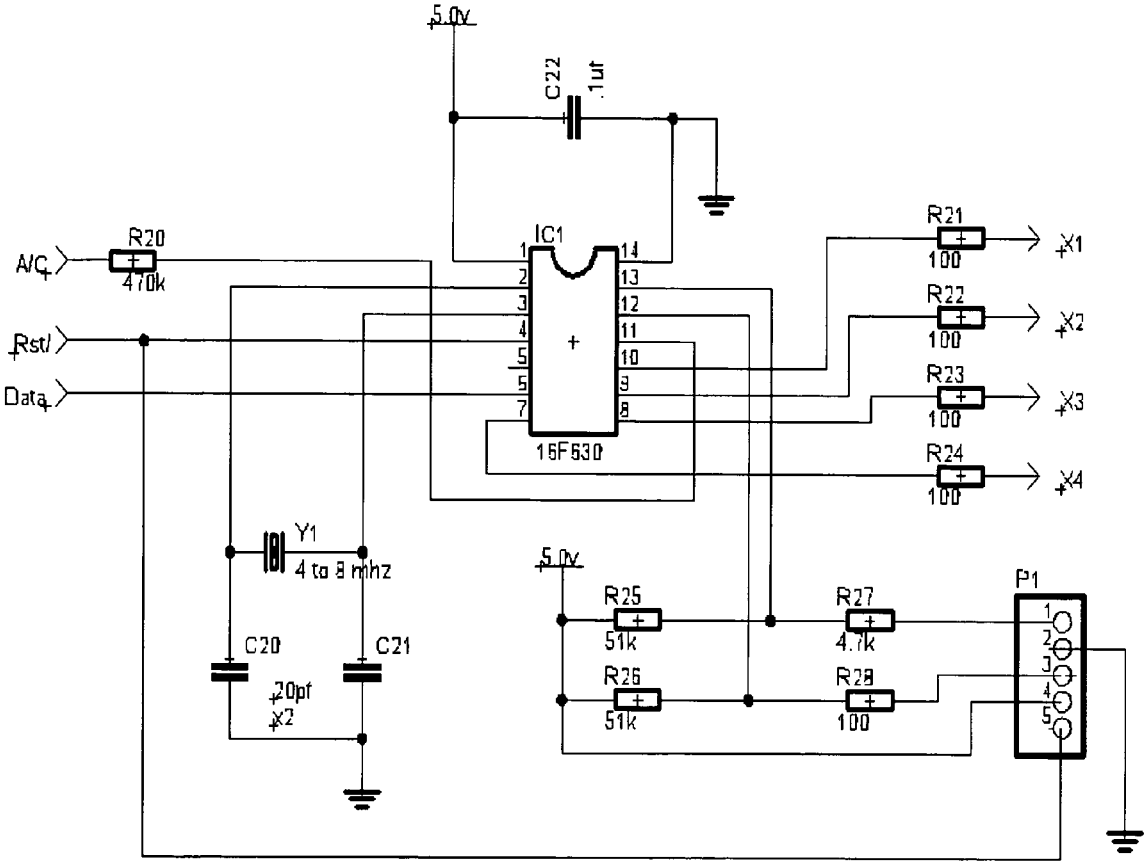
FIG. 2 is a diagrammatic view of the micro-controller decoder circuit of the present invention.

The pulse recovery circuit of FIG. 1 samples various signals in the model railroad environment. Currently the signals produced by the Lionel™ cab control are decoded for O and S gauge. With minor hardware and micro-code changes, this can be easily expanded to support the DCC cab control pulses for HO gauge. The pulses represent various commands as documented by the various manufactures of the controls. These pulses are fed into the micro-controller decoder circuit of FIG. 2. The micro-code within the micro-controller decodes the pulses into action commands. These commands represent key presses on the various remote controls. Once it is determined that the command is appropriate to this device, the output driver circuit of FIG. 3 is stimulated to provide the action.

Referring to the specialized power distribution circuit of FIG. 4, components D5 along with C4 and C5 provide the power noise immunity feature. The D5 component isolated the power to the micro-controller, while C4 and C5 provide power for a few seconds (a maximum of 5 seconds) providing stability for the micro-code running in the micro-controller.

Figure 3:
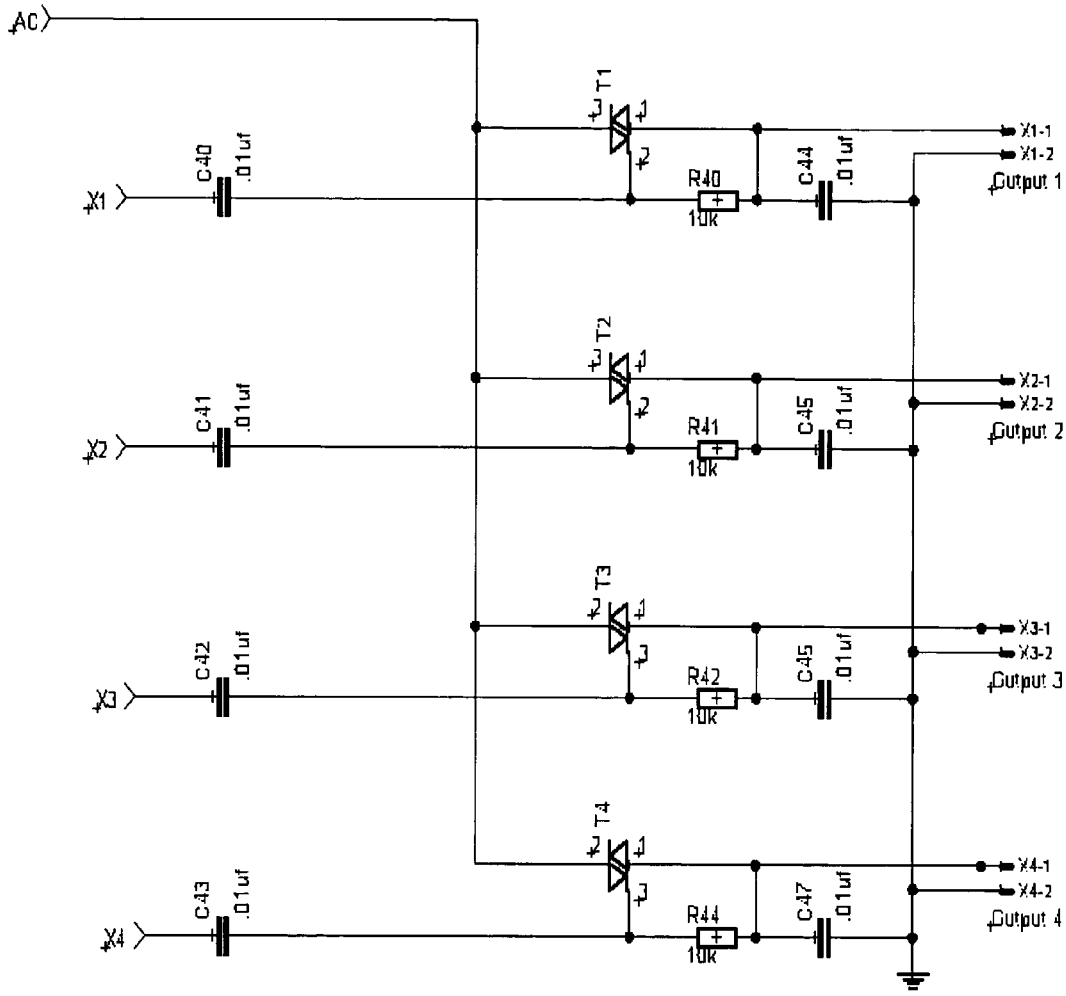
FIG. 3 is a diagrammatic view of the output driver circuit of the present invention.

To setup the correct behavior at the output driver of FIG. 3 to be a level or pulse, as well as the voltage selection; a configuration method is employed on the present invention. The user issues these commands via an existing remote control to the invention by entering Soft Set (Technology) Mode, or in case of an unknown unit ID—closing a switch set to configure mode. While in configure mode, the micro-code enters into a special mode to memorize the selections keyed into the remote control to configure the output(s) to be a pulse or level and what voltage to deliver the signal. This user configure-ability of the voltage and pulse timing allows the invention to be applicable to multiple accessories. If the voltage or pulse lengths are incorrect, the accessory will operate sub-optimally or malfunction.

The present invention uses the key press sequence entered to select voltages and a steady level or pulse to be delivered to the outputs. When the BOOST key is pressed a steady level will be delivered; alternately when the BRAKE key is pressed a pulse will be delivered. This sequence is delivered once in the configuration phase. Thereafter the use of the control will deliver these predefined voltages and pulses to activate the controlled device.

The present invention also delivers 2 on/off outputs at a desired percentage of the supplied voltage for controlling lighting or other appropriate on/off behavior accessories; bringing the total output drivers to 4 (four). With 4 outputs the invention will handle most accessories available today in the market. More outputs could be added in future releases.

Any operating car, trackside accessory, turnout switch, or any device that needs controllable power can be operated with the present invention. The present invention targets mobile, small size, programmable voltage/pulse environments.

Remote assignment of voltage and pulse duration is paramount to the success of this product, and is unique and key to the present invention. To avoid prior art problems with maximum voltage exceeding the capacity of the operating cars, with the introduction of the present invention; the operating cars can be retrofitted to run again. The present invention can remotely set the voltage for operation of the cars and accessories and can actually turn it on and off remotely.

Small size coupled with an integrated antenna make the receiving device of the present invention (FIG. 5) attractive and unique for use in environments never before possible. The present invention controls the operating car anywhere on the layout, and thereby eliminates the cost and relocation of operating tracks, wiring and switches to trigger them. For example, the present invention is only 0.95"×2" maximum and will tuck into any area above or below the operating car's limited space for electronics to control its operation. Many cars have only a small 1.5"×2.25" space underneath to attach circuitry. The present invention will fit nicely in this space, and with the integrated antenna will pick up the signals right at the rails it rides on.

Power noise immunity is a key attribute of the present invention and is accomplished with specialized power distribution that keeps the micro-controller supplied with voltage and running normally under brief interruptions of power. The key to operating cars control stability is managed by isolating the micro-controller power. This isolation allows the micro-controller to stay active when the power is briefly interrupted. While this may not keep the accessory running, the micro-controller will deliver the command signals reliably to the operating car so when full power is restored the car will operate correctly. If the power interruption is brief enough (less than a few seconds); the operating car will show no behavioral difference. If the power is interrupted long enough, the micro-controller will reset and stop the operating car functions. While this is desirable under long interruptions of power, many brief interruptions occur normally while an operating car moves along the track. The power circuitry keeps the operating car "alive" through these brief interruptions and provides continuous operation; which is the expected and desired behavior.

Remote programmability for class assignment is a unique feature in the present invention. This type of product currently in the marketplace responds only to engine command sequences. The present invention allows multi purpose assignment to the engine, accessory, or turnout switch class. This allows the present invention to be applicable to the various uses as described above. It would not be practical to control a turnout switch as an accessory or engine class. The invention memorizes the sequence applied at configure time and will respond to the class of command issued when in normal operation. For example, if the configure sequence uses ACC+ . . . keys, accessory commands will be decoded. Or, for example if the configure sequence uses SW+ . . . keys, turnout switch commands will be decoded.

A field upgradeable micro-controller firmware in the present invention allows for remote and electronic bug fixes and allows hobbyists to enhance the present invention operation. The field programmable micro-controller firmware allows for code updates to be made available to the user to correct and or enhance features in the field. The key to this feature is the P1 connector of the micro controller decoder circuit shown in FIG. 2. The P1 connector allows a "dongle" to be attached to a personal computer to upload any micro-code changes deemed necessary. This "dongle" can be made available for a low cost—or the hobbyist may opt to build the device. As hobbyists request new applications for the present invention, quick patches can be made and the hobbyist can electronically upgrade the invention and become instantly satisfied preferably with downloads from a website.

It is possible to make the basic firmware source available to limited OEM's to adapt the invention to a new series of products at their leisure. Thus the invention becomes a part of the development cycle for the OEM, insuring the continued use of the invention.

Soft Set Technology™ simplifies the configuration of the invention by employing unique key press sequence. Each unit shipped will come preprogrammed to ACC ID # 1. With the prior art a user would need to sequence power and flip a configuration switch to change this ID. While this is still supported, it is un-necessary with the present invention. To change the ID with the present invention, the user may select the invention with it's current ID, then press "SET" 5 times in a row with a 0.5 second pause between presses. Upon doing so, the invention will flash the output 3 signal (usually a lamp is attached here); and enter the configuration state. Simply waiting for 6 seconds will cancel the configuration sequence. If cancelled, the ID and output control selections will revert to its previous settings. Presumably, the user intended to change the ID and/or voltage & pulse settings; thus continuing with the configuration sequence will assign the new values. This sequence is identical with the sequence that would be followed by flipping the configuration switch. Using Soft Set Technology™, a user will be able to negate the power and switch-flipping regime to change an ID selection and output control settings on the present invention.

The present invention also works for larger trackside accessory operation. These trackside accessories usually take wires to connect from the power source then to on/off switches then to the accessory. Again this makes the accessory complicated to install or relocate. The present invention simply connects to the terminals under the accessory, and then hiding the invention under the accessory—simply connect the 2 wires to the track for power (as constant voltage is available there). Then to operate, simply dial in the accessory ID number on the remote cab and enjoy. Additionally, the accessory becomes painless to relocate and configure. The connection to the track is easily done via power connectors that snap on the track.

Trackside accessories include lights, turnout switches, or even an operating track for backwards compatibility as desired. For example to control a turnout switch; a user would configure the invention as follows:

After entry into configuration mode, continue by pressing keys on the remote cab control thusly:

SW+5+SET+AUX1+7+BRAKE+4—then—AUX2+7+BRAKE+4.

This sets the present invention to supply a one second pulse of 14 volts to each output of AUX1 and AUX2 to the turnout switch accessory number 5. The number 7 is the voltage supplied (multiplied by 2). The BRAKE selects a pulse to be delivered, while the 4 sets the pulse duration (multiplied by 0.25 sec)

When the present invention is connected to a turnout switch accessory, the pressing of the AUX1 or AUX2 buttons will supply the correct signals to the output driver circuit to operate the turnout switch controlling the path the train will follow.

If the environment deems the voltage is not proper (i.e.: different turnout switch manufacturer), the user can change the programming easily with the configuration process again. For example if turnout switch 22 requires 12 volts to operate, then the user would select: SW+22+SET+AUX1+6+BRAKE+4+AUX2+6+BRAKE+4. It is important to note that the voltage (in this case 6) or pulse length (in this case 4), is not required to be symmetrical; so SW+22+SET+AUX1+4+BRAKE+3+AUX2+7+BRAKE+8 is a valid entry.

It is understood that the preceding description is given merely by way of illustration and not in limitation of the invention and that various modifications may be made thereto without departing from the spirit of the invention as claimed.

What is claimed is:

1. An integrated controller system for railroad model accessories and operating cars, but not the driving engine, remotely programmed and controlled by an existing computer or an existing handheld transmitter, the system comprising:

a miniature remote receiving device comprising a built-in antenna, the receiving device attached to model railroad component in the form of an accessory or an operating car, but not the driving engine, in a location which is not readily visible, the receiving device comprising:

a pulse recovery circuit sampling and recovering a variety of pulses as recovered pulses in a model railroad environment, the pulses representing various commands used in a variety of different controls in a variety of different model railroad systems;

a micro-controller decoder circuit receiving the recovered pulses from the pulse recovery circuit and decoding the recovered pulses into action commands representing key presses on a variety of remote control devices;

an output driver circuit determining that a command is appropriate to a model railroad component to which it is attached and providing an action in response to the command;

a specialized power distribution circuit providing power noise immunity to keep the micro-controller decoder circuit supplied with voltage and running normally under brief interruptions of power;

the remote receiving device remotely programmed wirelessly by an existing remote control device to provide remote assignment of programmable voltage and pulse duration, and ID and class assignment and to provide at least one on/off output at a desired percentage of a supplied voltage for controlling lighting and other appropriate on/off behavior accessories separate from the driving engine, thereby creating an integrated controller system for railroad model accessories and operating cars but not the driving engine, remotely programmed and controlled by an existing computer or an existing handheld transmitter.

2. The system of claim 1 wherein the specialized power distribution circuit comprises a set of components isolating power to the micro-controller decoder circuit and at least one component providing power for a few seconds providing stability for a micro-code running in the micro-controller as a power noise immunity feature.

3. The system of claim 1 wherein the remote receiving device comprises a means to receive a micro-code to enter a special mode to configure a voltage output from the remote receiving device to be a pulse or level voltage output and at what voltage to deliver a signal to enable the system to be applicable to multiple accessories.

4. The system of claim 1 wherein the remote receiving device further comprises a programmed technique to allow for pulse length selection to allow a pulse duration to be of sufficient length to complete a specified action.

5. The system of claim 1 wherein the system further comprises a field upgradeable micro-controller firmware to allow for remote and electronic bug fixes and allow a user to enhance the system using code updates to correct and enhance features in the field.

6. The system of claim 5 wherein the micro-controller decoder circuit further comprises a connector to allow a "dongle" to be attached to a computer to upload any micro-code changes deemed necessary.

7. The system of claim 1 wherein the miniature remote receiving device is sized and configured to fit under or inside a model railroad car.

8. The system of claim 1 wherein the miniature remote receiving device is sized and configured to fit under or inside a model railroad trackside accessory.

9. The system of claim 7 wherein the miniature remote receiving device is at most one inch wide by two inches long by a half an inch high.

* * * * *